United States Patent [19]

Furukawa

[11] Patent Number: 5,056,396

[45] Date of Patent: Oct. 15, 1991

[54] OPENING/CLOSING APPARATUS OF KEYBOARD COVER

[75] Inventor: Tatsuo Furukawa, Shizuoka, Japan

[73] Assignee: Kawai Gakki Seisakusho Co., Ltd., Hamamatsu, Japan

[21] Appl. No.: 536,795

[22] Filed: Jun. 12, 1990

[30] Foreign Application Priority Data

Jun. 13, 1989 [JP] Japan ..... 1-68155[U]

[51] Int. Cl.[5] ..... G10C 3/02

[52] U.S. Cl. ..... 84/179

[58] Field of Search ..... 84/178, 179

[56] References Cited

U.S. PATENT DOCUMENTS

| | | | |
|---|---|---|---|
| 4,641,565 | 2/1987 | Tachida et al. | 84/431 |
| 4,656,913 | 4/1987 | Yoshikawa . | |
| 4,679,482 | 7/1987 | Simanski . | |
| 4,817,487 | 4/1989 | Yamashita | 84/179 |

FOREIGN PATENT DOCUMENTS

| | | |
|---|---|---|
| 53-85120 | 7/1978 | Japan . |
| 54-50527 | 4/1979 | Japan . |
| 58-48709 | 11/1983 | Japan . |
| 63-41898 | 2/1988 | Japan . |
| 1-285992 | 11/1989 | Japan . |

*Primary Examiner*—Brian W. Brown

*Attorney, Agent, or Firm*—Fleit, Jacobson, Cohn, Price, Holman & Stern

[57] ABSTRACT

This invention relates to an opening/closing apparatus for preventing abrupt fall and rotation of a keyboard cover in a keyboard musical instrument. The opening/-closing apparatus of a keyboard cover in accordance with the present invention is characterized in that an oil damper which includes a flange portion, a damper case and a back portion, allows a square end portion of a damper shaft to project from the surface of the flange portion and disposes a receptacle having a U-shaped groove encompassing the square end portion with a predetermined gap of the surface of the flange portion is buried at a predetermined position on the inner surface of each side plate of a musical instrument main body, recesses are formed on both side surfaces of a thick base portion of the keyboard cover, connecting members having tenon-like protuberances having slits at one of the end portions of the rod portion thereof are fitted into the recesses and the slits of the connecting members are meshed with both side surfaces at the square end portion of the damper shaft so as to connect rotatably and removably the keyboard cover to the musical instrument main body.

4 Claims, 2 Drawing Sheets

OPENING/CLOSING APPARATUS OF KEYBOARD COVER

BACKGROUND OF THE INVENTION

1. Field of the Invention

This invention relates to an opening/closing apparatus which prevents abrupt fall and rotation of a keyboard cover in a keyboard musical instrument.

2. Description of the Prior Art

Japanese Patent Laid-Open No. 41898/1988 proposes an apparatus having a construction wherein a coil spring is wound on a damper shaft supported rotatably inside a cylindrical case, a rotary damper is buried on both side surfaces at the rear end portion of the keyboard cover with one of its ends anchored to a recess of a cover portion of the case, a receiving metal is fitted to the inner surface of each crossarm or side plate of a musical instrument main body and the projecting end of the damper shaft is meshed with a U-shaped groove of the receiving metal so that when the keyboard cover is rotated by a predetermined angle in a closing direction, the spring fastens the damper shaft in order to thereby generate resistance and to mitigate drop impact.

However, since the damper member of the apparatus described above winds the coil spring on the damper shaft and stores it in the case which permits contraction and extension of the spring, it has a relatively large capacity but the keyboard cover is structurally limited so as not to impart any trouble in the appearance of the instrument, in the playing operation, in the fitting-/removing operation, and so forth. Therefore, even when the damper member described above is fitted to the thick base end portion, its fitting position is naturally limited. Since the support member of the damper case projects to the inner surface of the cover, flatness of the cover is lost. Furthermore, since the keyboard is supported by meshing the damper shaft with the U-shaped grooves of the receiving metals on the musical instrument main body side, the weight of the keyboard cover is always borne by the damper shaft and excessive force is applied to the damper shaft. Since the damper is of a spring type, there is the drawback that the keyboard cover tends to somewhat float under the finally closed state due to repulsive force of the spring.

SUMMARY OF THE INVENTION

It is therefore an object of the present invention to provide an opening/closing apparatus of a keyboard cover which provides a margin for the fitting position of a damper member, does not impair flatness of the inner surface of the key-board cover, does not either apply excessive force to the damper shaft but can close completely the keyboard cover.

To accomplish the object described above, the opening/closing apparatus of a keyboard cover in accordance with the present invention is characterized in that an oil damper which includes a flange portion, a damper case and a back portion, allows a square end portion of a damper shaft to project from the surface of the flange portion and disposes a receptacle having a U-shaped groove encompassing the square end portion with a predetermined gap on the surface of the flange portion is embedded at a predetermined position on the inner surface of each side plate of a musical instrument main body, recesses are formed on both side surfaces of a thick base end portion of the keyboard cover, connecting members having tenon-like protuberances having slits at one of the end portions of the rod portion thereof are fitted into the recesses and the slits of the connecting members are meshed with both side surfaces at the square end portion of the damper shaft so as to connect rotatably and removably the keyboard cover to the musical instrument main body.

When the keyboard cover is opened upward, the cover rotates easily and rapidly and when it is closed downward, it rotates lightly at the beginning but rotates slowly as it lowers.

The above and other objects and novel features of the present invention will become more apparent from the following description when taken in conjunction with the accompanying drawings.

DESCRIPTION OF THE PREFERRED EMBODIMENT

Hereinafter, a preferred embodiment of the present invention will be described with reference to the accompanying drawings.

Figure 1:
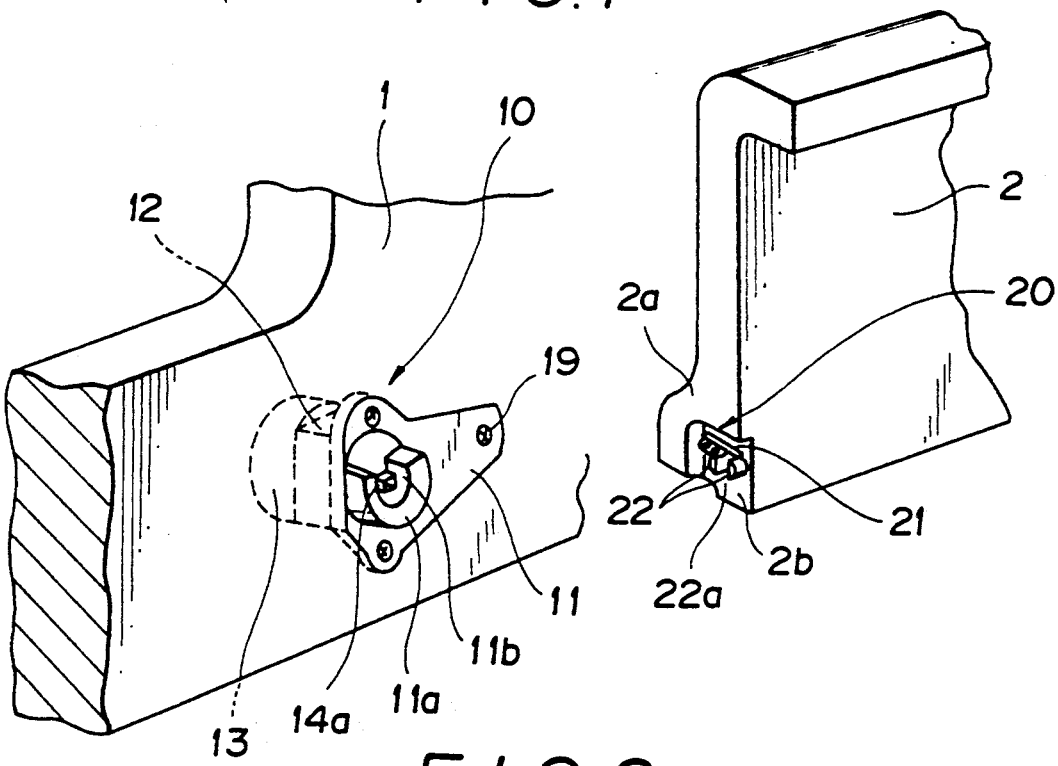
FIG. 1 is a partial perspective view of a crossarm and a keyboard cover of a keyboard musical instrument under the separated state.
Figure 3A:
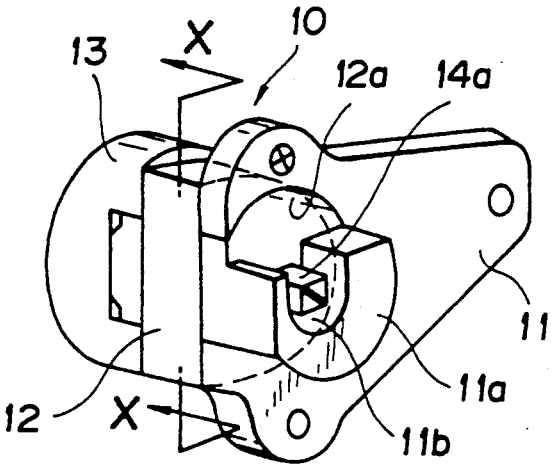
FIG. 3*a* is a prespective view of an oil damper.

In FIG. 1, reference numeral 1 represents crossarms (only the crossarm on one side is shown in the drawing) which constitutes part of a side plate of a keyboard musical instrument main body. An oil damper 10 consisting of a triangular flange portion 11, a damper case 12 equipped with an oil chamber 12*a* of a fan shape of about 90° to about 100° and a disc-like back portion 13 is embedded into a predetermined position at the rear part of the inner surface of the crossarm as shown in FIG. 3*a* in such a manner that the surface of the flange portion 11 is flush with the inner surface of the crossarm. The oil damper 10 is fixed by a plurality of set screws 19, and a square end portion 14*a* of a damper shaft projects from the center of the wide portion on the surface of the flange portion 12. There is also provided a receptacle member 11*a* which has a required thickness and is equipped with a U-shaped groove 11*b* for encompassing the square end portion 14*a* with a predetermined gap between them.

Figure 3B:
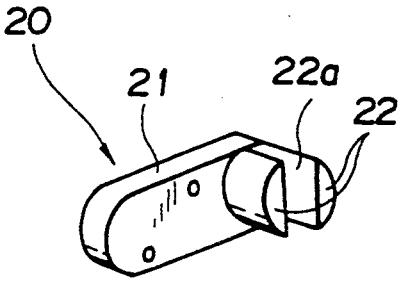
FIG. 3*b* is a prespective view of a connecting member.

Reference numeral 2 in FIG. 1 represents a keyboard cover. A recess 2*b* having such a size and depth as to accept therein a receptacle 11*a* on the flange portion 11 on the crossarm side is formed on both side surfaces (only one side is shown in the drawing) of the thick base end portion 2*a* of the keyboard cover in such a manner as to be opened on the inner surface side (on the front side of the sheet of drawings) and the end surface side of the cover 2. Tenon-like protuberances 22 having a slit 22*a* of the width capable of meshing with the square end portion 14*a* of the damper shaft are disposed at one of the ends of a rod portion 21 inside each recess 2b as shown in FIG. 3b, and a connecting member 20 having said protuberances 22 is fitted in such a manner that its rod portion 21 is in parallel with the base end surface of the cover 2 and the protubernaces 22 are positioned on the inner surface side of the cover.

Figure 2:
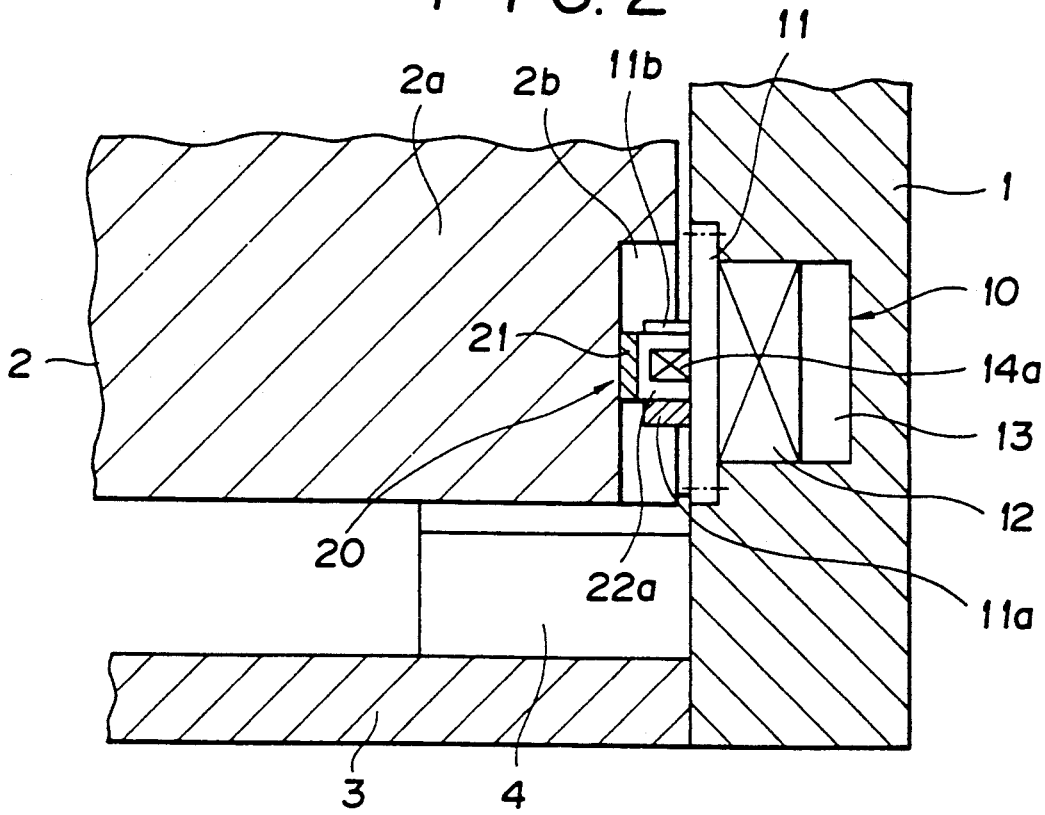
FIG. 2 is a one-side sectional view of the keyboard cover under the assembled state when viewed from the back.

The keyboard cover 2 is assembled rotatably and removably to the crossarms 1 of the musical instrument main body as shown in FIG. 2 in the following way by allowing the slits 22a of the protuberances 22 of the connecting members on both sides to mesh from the above with the both side surfaces at the square end portion 14a of the damper shaft projecting toward the inside of the crossarm 1 while the keyboard cover 2 is erected or under the open state as shown in FIG. 1. In this instance, the weight of the keyboard cover 2 is not applied to the damper shaft but is supported by the receptacles 11a.

In FIG. 2, reference numeral 3 represents a key bed and reference numeral 4 represents a fixed block disposed below both sides of the keyboard cover 2.

Figure 4A:
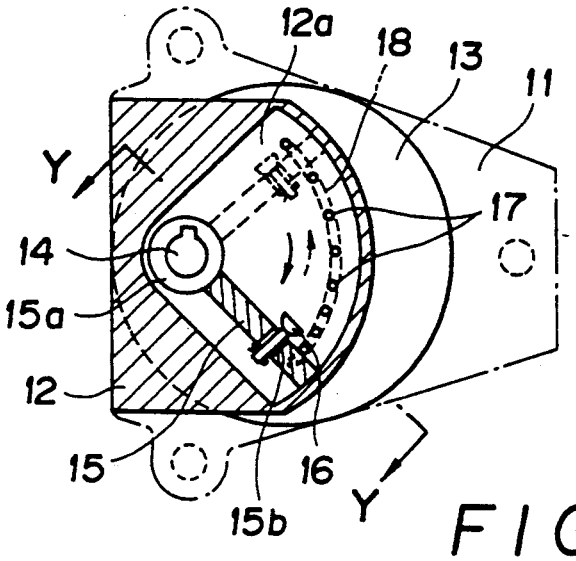
FIG. 4*a* is a sectional view taken along line X—X of FIG. 3*a;*
Figure 4B:
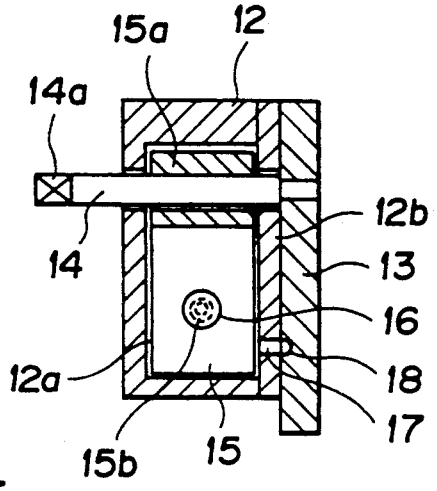
FIG. 4*b* is a sectional view taken along Y—Y of FIG. 3*b*.

FIGS. 4a and 4b show the interior of the damper case 12 of the oil damper 10. A silicone oil is sealed into the fan-shaped oil chamber 12a and the damper shaft 14 is disposed at a pivot position on one of its sides in the crossing state. The damper shaft 14 is supported rotatably and air-tight by the front and rear side walls of the case 12 and one of its ends projects from the surface of the flange portion 11 and forms the square end portion 14a.

A strap 15 is fixed to the damper shaft 14 through a boss 15a inside the oil chamber 12a and a through-hole 15b is bored at the center of the strap 15. An elongated end portion of a poppet valve 16 with its head up is fitted into this through-hole 15b so that the poppet valve 16 is loose but cannot fall off. A plurality of small holes 17 are disposed along one arc at the peripheral portion of the rear wall 12b of the damper case 12 with the gaps which are smaller on the lower side and become progressively greater on the upper side. These small holes 17 communicate with one another by side passage 18 bored in the back portion 13.

Figure 5:
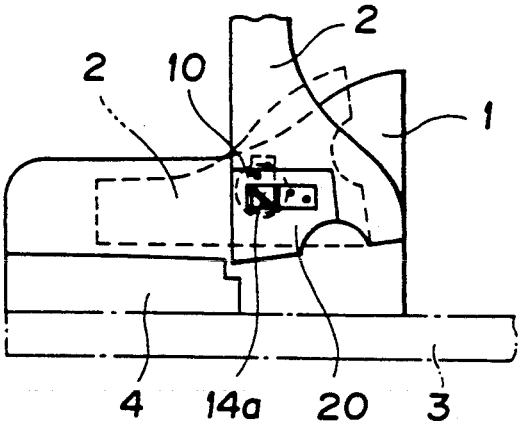
FIG. 5 is a partial side view showing the open/closed state of the keyboard cover.

When the keyboard cover 2 connected to the damper shaft 14 through the connection member 20 is rotated upward (in the opening direction), the strap 15 inside the oil chamber 12a rotates downward as represented by arrow of solid line and the head of the poppet valve 16 fitted into the through-hole 15b of the strap 15 leaves the through-hole 15b so that the oil inside the oil chamber can now move freely through the through-hole 15b and the strap 15 and hence, the keyboard cover 2, can be freely rotated without resistance. Under the open state of the keyboard cover 2 as represented by solid line in FIG. 5, the strap 15 reaches the position represented by lower solid line.

When the keyboard cover 2 is rotated downward (in the closing direction) under this state, the strap 15 rotates upward as represented by arrow of dash line trough the damper shaft 14 and at this time, the head of the poppet valve 16 is brought into pressure contact with the through-hole 15b of the strap 15 by the resistance of the oil inside the oil chamber and closes the through-hole. Accordingly, the oil existing above the strap 15 is pushed to the side of the strap 15 and flows to below the strap 15 through the small holes 17 in the rear side wall 12b and the side passage 18 of the back portion 13. At the beginning of rotation, however, the oil resistance is small because the number of small holes 17 positioned above the strap 15 is great so that rotation is relatively gentle. When rotation continues, the number of small holes 17 becomes smaller the and their gap between them becomes longer. Accordingly, the oil resistance increases gradually and the strap 15 rotates gently. In other words, the keyboard cover 2 rotates gently as its abrupt drop is mitigated. When the keyboard cover 2 is closed as represented by dash line in FIG. 5, the strap 15 occupies the position on the upper dash line. Incidentally, the oil damper 10 described above is merely illustrative but not limitative and therefore, it may be changed or modified appropriately so long as it can control the opening operation of the keyboard cover 2 to be relatively resistance free and its closing operation to be gradually slower.

In accordance with the present invention, the oil damper for damping the keyboard cover is not disposed on the keyboard cover having a limited fitting space but is fitted to the side plate of the musical instrument main body having a relatively large fitting area, as described above. Accordingly, the fitting work can be made easily without spoiling flatness of the inner surface of the keyboard cover. Since the slits of the connecting member on the cover side are meshed with both side surfaces of the square end portion of the damper shaft and the receptacle of the damper flange portion is caused to bear the weight of the keyboard cover, the damping operation can be made smoothly without applying any excessive force to the damper shaft and fitting and removal of the keyboard can be made easily. Further, since the damper is of the oil type, the operation is more flexible in comparison with a damper of a spring type.

What is claimed is:

1. A musical instrument having a keyboard with side plates at opposite ends of the keyboard and a keyboard cover pivotally attached to the side plates through respective pivot connections wherein at least one of said pivot connections includes a liquid damper having a liquid filled damper chamber, a damper shaft having a first portion extending into the chamber and a second portion extending outwardly from the chamber to provide a pivot shaft of said pivot connection, a damper vane carried by said shaft in the damper chamber for movement through the liquid when the cover is opened and closed, and an array of apertures in one wall of the chamber, the apertures being inter-connected by a flow passage outside of the chamber for passing liquid between opposite sides of the vane as the vane moves through the liquid during opening and closing movements of the cover.

2. The musical instrument as claimed in claim 1 wherein said apertures are disposed in an arc substantially concentrically with the damper shaft and wherein the apertures are differentially spaced apart to provide a gradual deceleration of the cover during said closing movements.

3. The musical instrument as claimed in claim 1 wherein the damper vane includes a one-way valve adapted to open during opening movements of the cover, for passage of liquid therethrough and to close during closing movements of the cover whereby said opening movements can be effected more rapidly than said closing movements.

4. The musical instrument as defined in claim 1, wherein the damper is embedded in one of said side plates, the pivot shaft has a rectangular profile and is surrounded by a cup-like retainer carried by the respective side plate, and wherein the cover has tenon-like protrusions embracing the pivot shaft and supported by said retainer when the cover is in fully open position so as to relieve the pivot shaft of a load imposed by the cover.

* * * * *